US005648908A

United States Patent [19]

Chirn et al.

[11] Patent Number: 5,648,908

[45] Date of Patent: Jul. 15, 1997

[54] COMPUTER-AIDED EMBROIDERY MACHINE FOR PATTERN AND DATA PREPARING AND TESTING AND METHOD OF USING THE SAME

[75] Inventors: Jin-Lung Chirn; Wen-Chin Cheng, both of Hsinchu; Han-Chieh Chang, Taipei, all of Taiwan

[73] Assignee: Industrial Technology Research Institute, Hsinchu, Taiwan

[21] Appl. No.: 381,564

[22] Filed: Jan. 31, 1995

[51] Int. Cl.[6] ..... G06F 19/00; D05B 21/00

[52] U.S. Cl. ..... 364/470.06; 364/470.09; 112/470.06; 112/80.23

[58] Field of Search ..... 364/470, 470.09, 364/470.02, 470.03; 112/102.5, 121.12, 103, 121.22, 470.06, 78, 80.23, 470.04, 475.18, 475.19

[56] References Cited

U.S. PATENT DOCUMENTS

| | | | |
|---|---|---|---|
| 4,383,489 | 5/1983 | Sugiyama et al. | 112/103 |
| 4,388,884 | 6/1983 | Hirota et al. | 112/121.12 |
| 4,982,674 | 1/1991 | Hayakawa | 112/121.12 |
| 5,072,680 | 12/1991 | Nakashima | 112/445 |
| 5,181,176 | 1/1993 | Hayakawa | 364/470 |
| 5,189,622 | 2/1993 | Hayakawa et al. | 364/470 |
| 5,270,939 | 12/1993 | Goldberg et al. | 364/470 |
| 5,283,748 | 2/1994 | Muramatsu | 364/470 |
| 5,311,439 | 5/1994 | Hayakawa et al. | 364/470 |
| 5,319,565 | 6/1994 | Hausammann et al. | 364/470 |
| 5,335,182 | 8/1994 | Asano | 364/470 |
| 5,343,401 | 8/1994 | Goldberg et al. | 364/470 |

*Primary Examiner*—Joseph Ruggiero
*Attorney, Agent, or Firm*—W. Wayne Lianh

[57] ABSTRACT

A computer-aided embroidery method for preparation and testing of a predetermined pattern is disclosed. The method comprises the steps of (a) comparing the size of said pattern with an embroidery table device to determine if an intended embroidery operation will exceed a defined boundary of said embroidery table device; (b) determining an embroidery frame; and (c) providing a completed simulation and a trial embroidering process within said embroidery frame without actually lowering a needlebar for testing the validity of a pattern layout. A machine implementing this method is also disclosed.

10 Claims, 8 Drawing Sheets

| θ (Degree) | r |
|---|---|
| 0 | $r_0$ |
| 1 | $r_1$ |
| 2 | $r_2$ |
| 3 | $r_3$ |
| ..... | ..... |
| 359 | $r_{359}$ |

COMPUTER-AIDED EMBROIDERY MACHINE FOR PATTERN AND DATA PREPARING AND TESTING AND METHOD OF USING THE SAME

FIELD OF THE INVENTION

This invention relates to a computer-aided embroidery machine and method that offer improvement in pattern and data preparation and testing for embroidery operations.

BACKGROUND OF THE INVENTION

According to the many methods of operation involved in computer-aided embroidery machines prevailing on the market nowadays, the operators have to designate the patterns and set the embroidering conditions in advance. Quite often either the embroidering operation will exceed the embroidering range of the embroidery table such that the danger of machine bumping occurs, or the pattern contour embroidered will exceed the range of the embroidery frame. In both situations, the machine won't meet the required performance. However, if the operators adopt a relatively conservative way of setting the operating conditions in order to prevent the machine bumping from occurring, they cannot make the most of the embroidering space of the machine table, thereby imperceptibly reducing the available area used by the machine table, and greatly reducing its practical use.

On the other hand, as it was taught in the prior art, Japan's patent No. 63-105787 discloses a method to attain the embroidering testing function by use of a display device. The method disclosed therein is to show the actual embroidered pattern and the embroidery frame on the display device to allow the use to determine if the pattern is beyond the range of the embroidery frame. One of the shortcomings of this method is that the operator needs to have the geometric contour of the embroidery frame and its corresponding locations of the machine table, so as to be able to attain the embroidering result on the display device. The embroidery setup lead time can be greatly improved, and the chances of machine malfunction and damages can also be reduced greatly. Another prior art, Japan's patent No. 63-197488, discloses a method which requires the operator to examine only the relative locations between the needlebar and the embroidery frame during the course of embroidering testing without having to drop the needle but only have to move the frame. The shortcoming is that the user needs to perform the embroidering testing, stitch by stitch, to embroider the whole pattern beyond the frame. It is very time-consuming, and, therefore, is not practical. As for U.S. Pat. No. 5,072,680, it discloses a method to project, by installing a light source projector on the top of the embroidery frame, the range of the actual embroidering area, on the embroidery table to provide the operators with the information if the size of the pattern intended to embroider exceeds the range of the embroidery frame. However, the shortcoming of this method is that the user needs to add an additional hardware which would raise the machine cost accordingly.

SUMMARY OF THE INVENTION

This invention discloses a computer-aided embroidery machine for pattern and data preparation and testing, and a method of using the same. It mainly makes use of a computer to calculate, in advance, the actual length and width of the pattern intended to be embroidered. With the present invention, the embroidery machine can be examined if it is beyond the machine table's boundary before starting embroidering. The present invention causes the embroidering table device to follow the rectangular boundary of the pattern's surroundings and move a cycle around to facilitate the users to observe if the embroidering range falls within the range of the embroidery frame, and to show quickly the embroidering pattern on the display device. It allows the operators to examine if the preset embroidering condition is correct. By use of the computer control, it divides the data processing procedure into three steps; preprocessing data management, postprocessing data management, and machine embroidering testing. In coordination with the functions of the controller device, the drive of the embroidery table device, and the needlebar, the present invention can shorten the time required for preparation and protect the machine from the danger of being damaged as a result of improper operation.

DETAIL DESCRIPTION OF PREFERRED EMBODIMENTS

Figure 1:
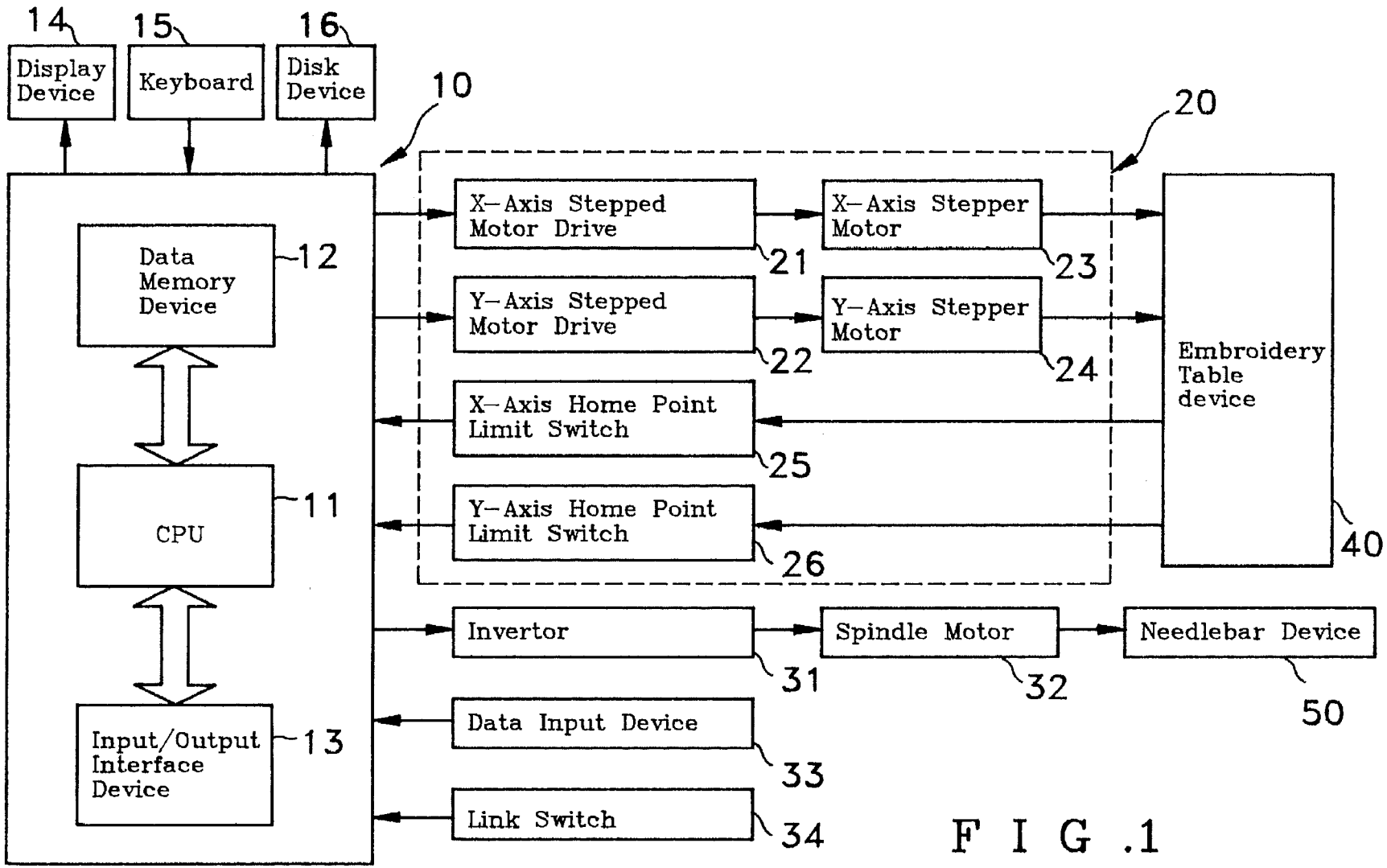
FIG. 1 is a structural block diagram of a preferred embodiment of the present invention.

Please refer to FIG. 1, which shows the structural block diagram of a preferred embodiment of the present invention. In FIG. 1, the controller (10) comprises mainly a CPU (11), a data memory device (12), and an I/O interface device (13). The way of connection is to have the CPU act as the center which is connected to the data memory device (12) and the I/O interface device (13), respectively, and then is externally connected to the display device (14), keyboard (15), and disk device (16). By this way of connection, the controller (10) can be constructed by either adding an extra memory to a single chip together with an I/O interface, or by connecting each hardware facility by use of a PC-based system in coordination with I/O interfaces. In addition, the controller (10) is connected to X, Y axes stepped motor drives (21), (22), then connected to X, Y axes stepped motor (23), (24), finally to the embroidery platform device (40). It can control the planner movement location of the embroidery table device. The embroidery table device (40) connects also to the X, Y axes Home point limit switch (25), (26), then back to controller (10). The user can determine if the embroidering range is beyond the defined boundary to decide whether he or she can continue performing the embroidering operation. The controller (10) also connects to an invertor (31), and the output of this invertor (31), and then connects to the spindle motor (32), then to the needlebar device (50). It can control the embroidering motion of the needlebar device (50). The controller also has a data input device (33) and a link switch (34) connected to it. The data input device (33) can cause the data, which is related to the hardware facilities, to be input to the controller (10), and process them. Besides, the link switch (34) can cause the needlebar to perform consistent embroidering movements. The devices stated above which include the X, Y axes stepped motor drives (21), (22) and the X, Y axes stepped motor (23), (24), together with the X, Y axes home point limit switch, can be constructed into an integrated embroidery table device's drive (20). The integrated device of this invention's implemented example can be installed in common sewing machines to facilitate the embroidering operation.

Figure 10:
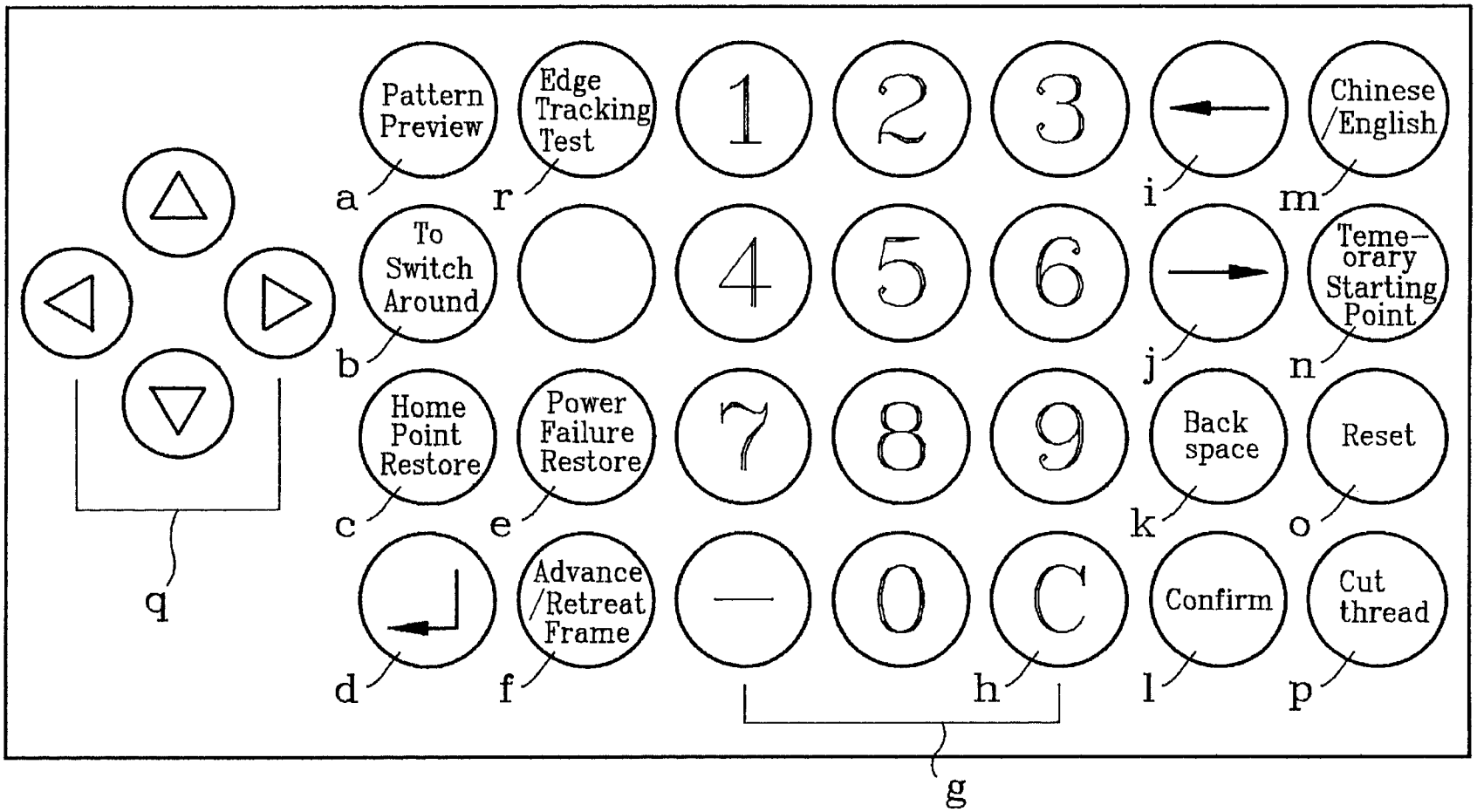
FIG. 10 is a scheme of the keyboard planning of a preferred embodiment of the present invention.

The layout of keyboard (15) is shown in FIG. 10. The function of each key is defined as follows:

(a) "Pattern Preview":
To display the color of a pattern according to the designated color of the needlebar (b) "Switch" key:
To switch between "edit page" and "instant display page" when the machine is down.

(c) "Home Point Restore" key
After pressing this key, it can return back to the embroidering starting point of that particular embroidering pattern during the course of the embroidering.

(d) "←" key
Input confirmation key after the required numbers are entered.

(e) "Power Failure Reset" key:
To restore the function after power failure.

(f) "Advance/Retreat Frame" key:
To allow the moving of the table to be made manually, the moving directions of the controlled table are all shown on the instant display page which gives strings of word cues during machine operation.

(g) "Digit" key
Contains required digits 0~9 for input.

(h) "C" key;
Clear key, to clear incorrect information and input data.

(i) "←" key
To move the cursor one space to the left.

(j) "→" key
To move the cursor one space to the right.

(k) "Backspace" key
To clear the word where the cursor is located and move the cursor one digit position leftward.

(l) "Confirm" key
To confirm the name of the pattern input.

(m) "Chinese/English" key:
To switch between Chinese and English display.

(n) "Temporary Starting Point" key
To set up a temporary starting point (o) "Reset" key:
To discard the existing embroidering operation and to start a new embroidering operation.

(p) "Cut Thread" key:
To cut the thread.

(q) "Frame Moving" key:
To move the embroidery frame to the desired direction and location.

(r) "Edge Tracking Test" key:
When setup or change a new pattern, to enable the embroidery frame to make a completed simulation trip to test if the parameter setting works properly within the allowable embroidery boundary.

Figure 2:
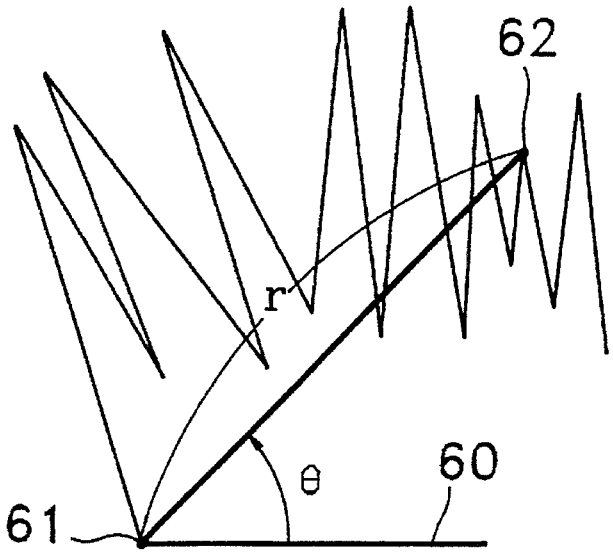
FIG. 2 is an illustration of the definition related to r and θ of a preferred embodiment of the present invention.
Figure 3:
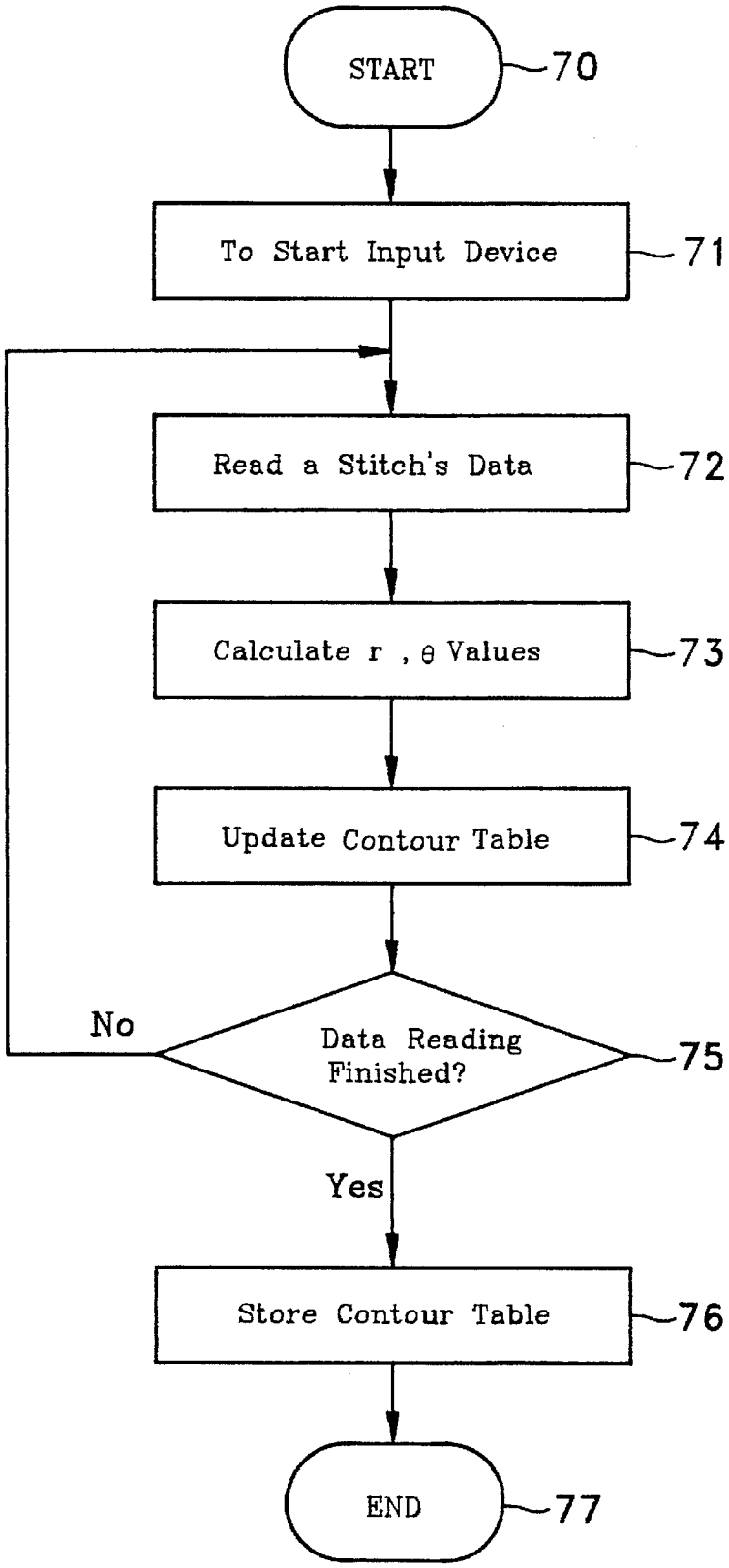
FIG. 3 is a preprocessing data management flowchart of a preferred embodiment of the present invention.

By the use of the embroidering testing method of this invention, its procedure can be divided into three steps: preprocessing data cycle, postprocessing data cycle, and machine embroidering testing cycle. The explanations of each of the three cycles are as follows:

(1) Preprocessing Data Cycle:

When the pattern's stitch data is input to the disk device by use of a floppy disk (16) (we can also input to the tapereader by use of a papertape), the controller will first establish a table of a pattern contour's outline, then commencing from the pattern's needle starting point, calculates, stitch by stitch, the relative distance r and angle θ of any stitch point with respect to the start stitching point (61), as shown in FIG. 2. It contains horizontal line (60), the pattern's start stitch point (61), and any stitch point (62). The calculation of the contour table of the pattern contour will be finished after the pattern's data input is done. The table uses the pattern's needle starting point (61) as a reference point to record each degree of the outline of the pattern contour. Finally, the results of this table are stored in the data memory device (12) or in the floppy disk through the disk device. The flow chart of this preprocessing data management is shown in FIG. 3. The detailed description of the flowchart is as follows: Commencing with "START (70), then "OPEN THE INPUT DEVICE" (71) and "READ IN A STITCH's DATA" (72), then "CALCULATE THEIR r, θ VALUES" (73) based on the stitch's data. These values, which were transformed during the process, are in polar coordinates and have become "UPDATE CONTOUR TABLES" (74) subsequently, to be used to determine if "DATA READING ARE COMPLETED?" (75). If the answer is yes, then STORE THE CONTOUR TABLE" (76), and end with the step "END" (77). If the answer is no, then the process goes back to repeat the step "READ IN A STITCH's DATA" to read the next stitch's data, so as to attain the object of establishing the contour's table.

Figure 4:
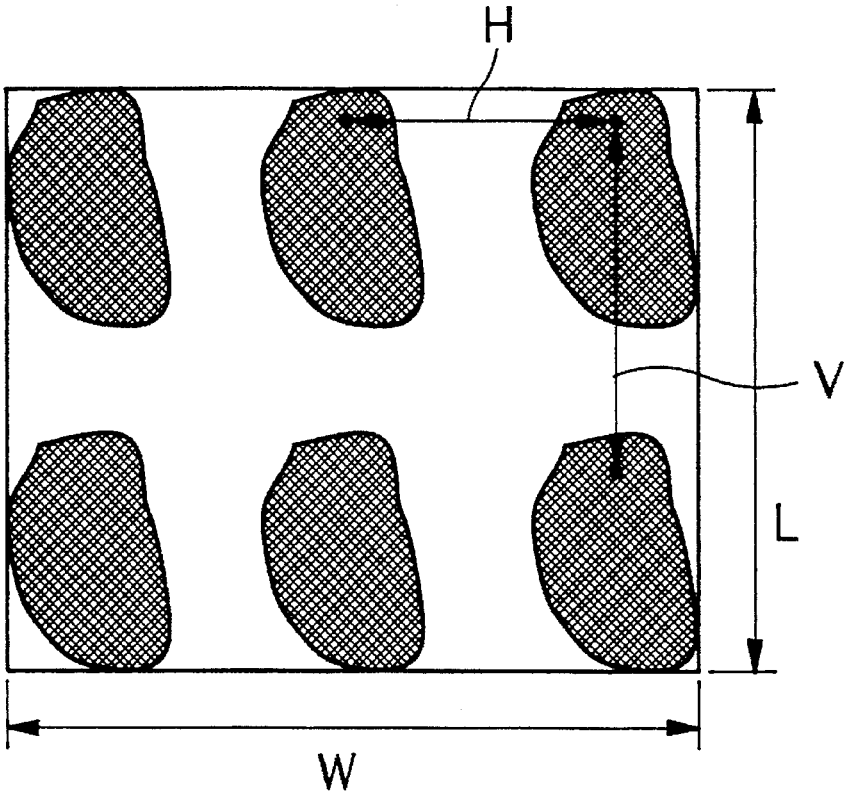
FIG. 4 is an illustration of the maximum length and width of the actual embroidering pattern of a preferred embodiment of the present invention.
Figure 6:
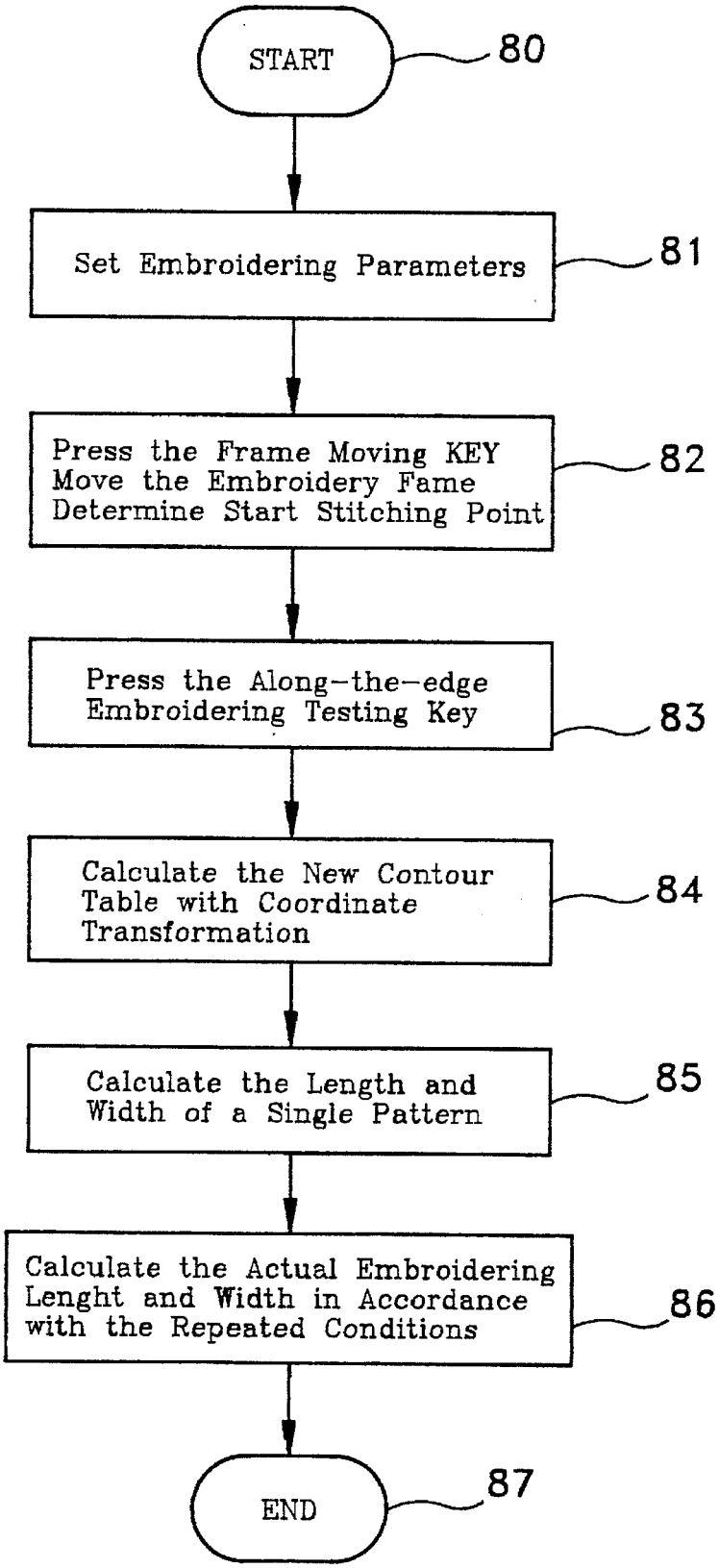
FIG. 6 is a postprocessing data management flowchart of a preferred embodiment of the present invention.
Figures 5, 9:
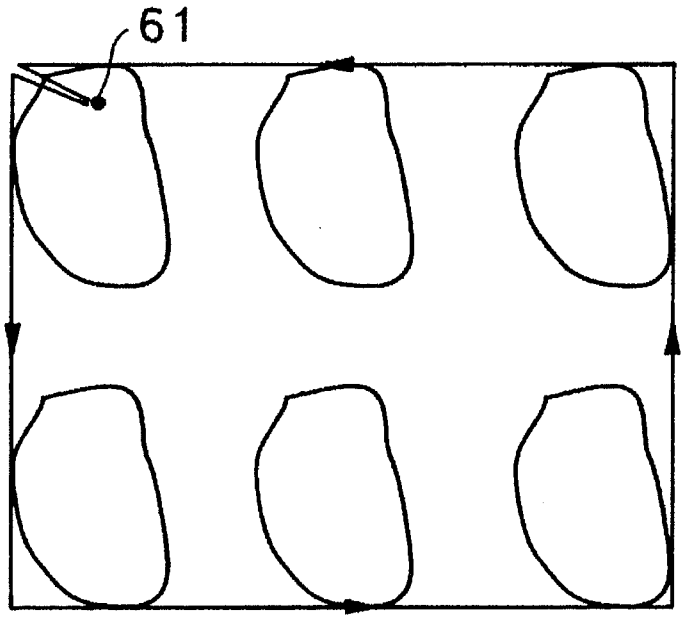
FIG. 5 is an embroidering testing's moving locus of the embroidery table device of a preferred embodiment of the present invention.
FIG. 9 is a table scheme of the pattern's contour of a preferred embodiment of the present invention.

(2) Postprocessing Data Cycle:

This cycle is provided for setting the maximum allowable length and width of the embroidering frame for a selecting pattern. FIG. 6 illustrates the postprocessing procedures. When an operator chooses a prerecorded pattern stored in the controller (10) and sets up the conditions of embroidering parameters and repeated embroidering, etc., he or she can accomplish a number of tasks, including performing the pattern's coordinate transformation (scaling, rotation, and mirror reflection). And by use of "frame moving key", which is established on the keyboard (15) to move the embroidery table device (40) and to cause the embroidery frame to move on the embroidery table device (40), by designating the pattern's start stitch point (61), the user then presses the "embroidering testing along the edge" key. The controller (10) will use the data from the table of contour outline of the original pattern, obtained from the preprocessing data management, to calculate the new contour table which is obtained after the coordinate transformation. Then, it also calculates the horizontal and vertical projected values for each contour point relative to pattern start stitching point (61), thereby obtaining the range in length and width of the pattern after repeated conditions (including horizontal repeated numbers, vertical repeated numbers, horizontal and vertical intervals) which are set by the operators to calculate the actual pattern's maximum length (L) and width (W). FIG. 4 shows the maximum length (L) and width (W) of the actual embroidering pattern of a preferred embodiment of the present invention. FIG. 5 shows the moving locus of the embroidery table device during the embroidering testing of this invention's implemented example. As for the flowchart of the postprocessing data management, please refer to FIG. 6. The detailed description of the flowchart is as follows:

Commence with "START" (80), then "SET UP EMBROIDERING PARAMETER" (81). After that, "press the frame moving key to move the embroidering frame to determine the start stitching point" (82), then press the "along the edge embroidering testing key" (83), then "calculate the new contour table which has the coordinate transformed" (84), following that is "to calculate the length and width of a single pattern" (85), then execute "according to the repeated conditions to calculate the actual embroidering length and width" (86), and end with the step "END" (87). By doing this, we can calculate the maximum length (L) and width (W) of an actual embroidering pattern.

Figure 7:
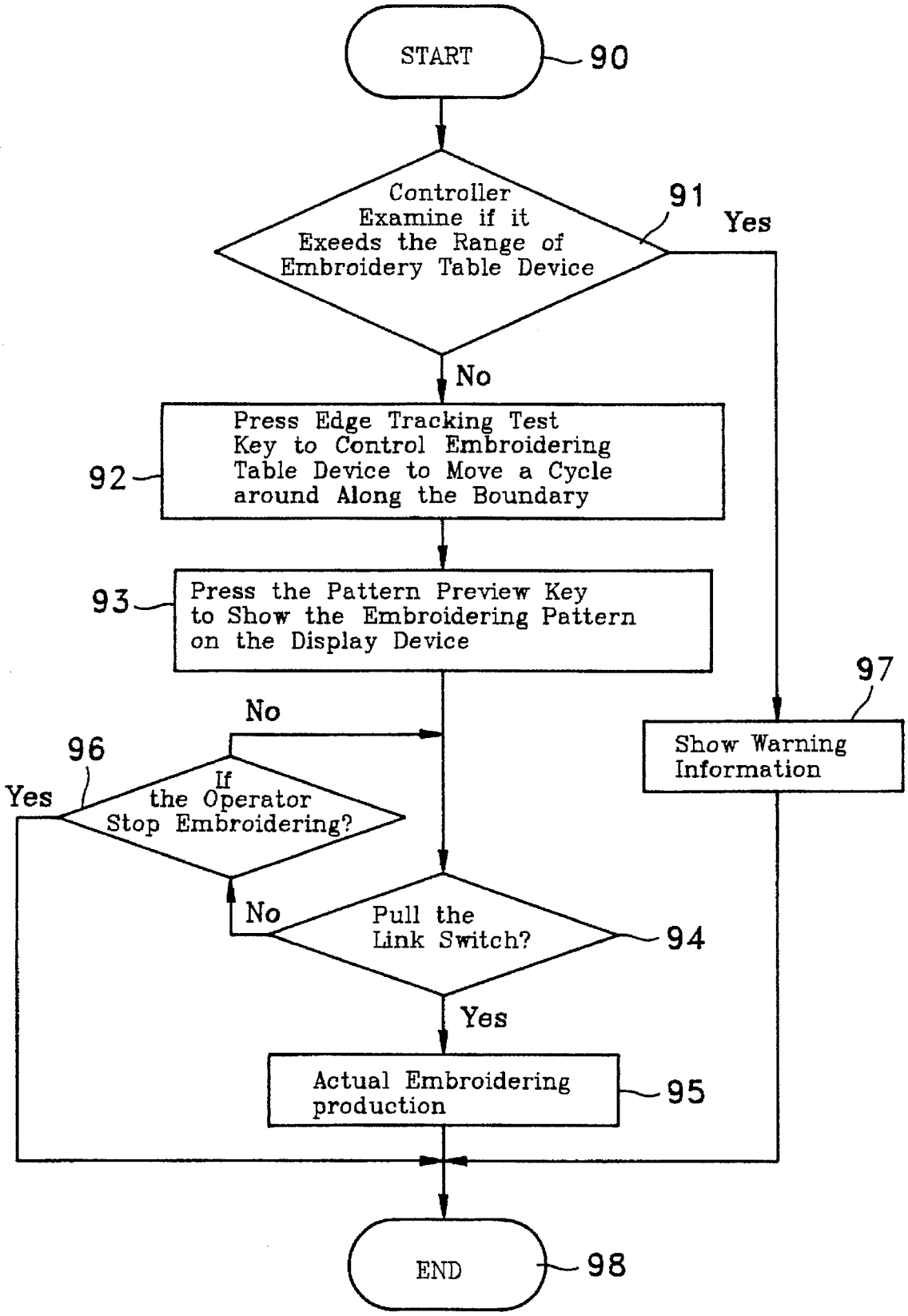
FIG. 7 is an embroidering testing flowchart of a preferred embodiment of the present invention.
Figure 8:
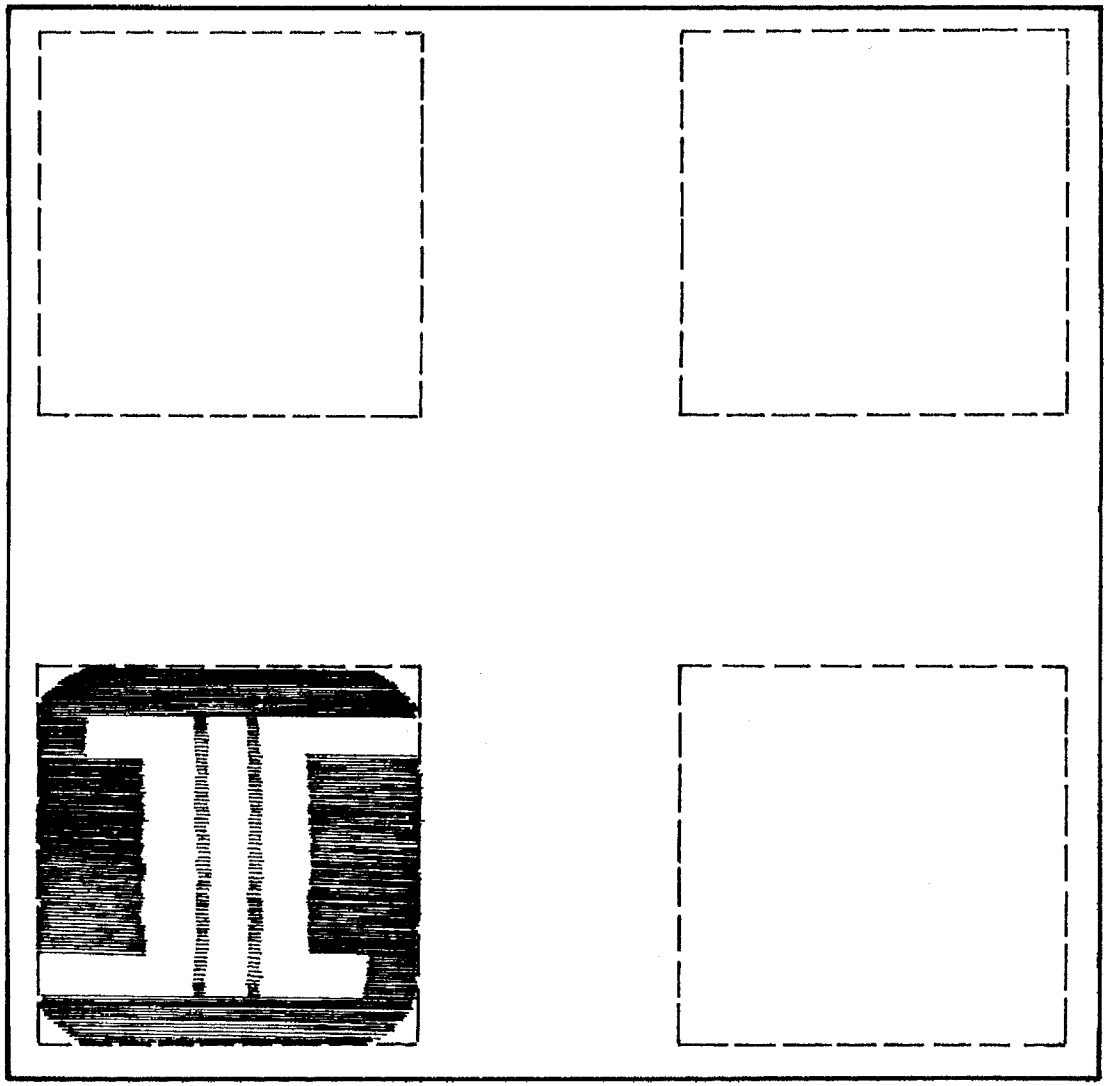
FIG. 8 is a displayed picture on the display device while in repeated embroidering according to a preferred embodiment of the present invention.

(3) Machine Embroidering Testing Cycle:

When the postprocessing data management calculates the pattern's area, the controller (10), according to the locations of the needlebar device (50), will examine whether the pattern exceeds the range of the embroidery table device (40). If it does, the display device (14) will show this information and stop the embroidering process. If it doesn't, then the controller (10) will prevent the needlebar device (50) from performing the up-and-down embroidering motion (i.e. the spindle motor (32) will not rotate), instead, it will control the embroidering table device (40) and further make the embroidery frame, on top of the embroidery table, to complete, as shown in FIG. 5, along the locus of the rectangle's boundary, one cycle in low speed. In this way, the operators can observe if the embroidering range falls within the required embroidery frame. In the meantime, the controller (10) will adjust the embroidery patterns in proper proportion and show them on the display device. Also, while performing the repeated embroidering, in order to reduce the displayed time on the display device (14), it draws only one detail embroidery pattern as a model, while the rest of the repeat patterns are shown by rectangular outline in dotted lines to represent their pattern locations (as shown in FIG. 8), to provide operators to confirm if the parameters established are correct. If the results, alter embroidering testing, show that they are all right, then we can pull the link switch (34) to execute the actual embroidering motion. The detailed explanation of the machine's flow chart of embroidering testing is as follows (please refer to FIG. 7):

Commencing with "START" (90), by means of the locations of the needlebar device (50) and using the pattern area calculated by the "postprocessing data management", the controller will examine if the embroidery pattern exceeds the embroidering range (91) of the embroidering table device. If it does, then the display device (14) will show abnormal information (97) and stop the embroidering testing process and finish with "END(98)". If it doesn't exceed the range of the embroidery table device, then by pressing the "Edge Tracking Test" key, the needlebar device will not perform the up-and-down embroidering motion but will control the embroidery table device to move one cycle around along the pattern's boundary (92). By pressing the pattern preview key, it shows the embroidery pattern on the display device (93), then sees if it pulls the link switch (94) If it does, the needlebar will perform the actual embroidering production (95), and finally finishes by "END" (98). If it doesn't, then the operators stop embroidering (96) to determine whether or not to continue executing the embroidering motion.

As to the method of calculation of the embroidery range according to a preferred embodiment of the present invention, the calculation method of the preprocessing data management, as stated above, calculates, stitch by stitch, the relative distance r and angle θ of the relative pattern's start stitch point (61) of each stitch point, and establishes a table, as shown in FIG. 9. However, the calculation method of the postprocessing data management, according to the sequence and nature of the repeated embroidering, can be divided into two modes: the coordinate transformation of the table, and the handling of the repeated embroidering.

They are explained as follows:

(1) The coordinate transformation of the table:

There are three different ways of coordinate transformation, which include proportion transformation, rotation transformation, and mirror reflection transformation. Assume the original table is expressed by $R=F(\theta)$ and the new table after the transformation is expressed by $r'=F'(\theta)$, then the explanations of each kind of transformation are as follows:

(a) Proportion transformation:

If the proportional constant is k (k=1, indicates same scale; k>1, indicates magnification; k<1 indicates reduction)

When the pattern is K times larger than the original one, then $$r'=F'(\theta)=k\cdot F(\theta) \quad (1)$$

(b) Rotation transformation:

If the rotation angle of the original pattern is δ degree, then $$r'=F'(\theta)=F[(\theta+\delta)\bmod 360] \quad (2)$$

(c) Mirror reflection transformation:

If reflects with respect to x-axis, then $$r'=F'(\theta)=F[(360-\theta)\bmod 360] \quad (3)$$

If reflects with respect to y-axis, then $$r'=F'(\theta)=F[(180-\theta)\bmod 360] \quad (4)$$

If reflects with respect to the origin (the start stitch point), then $$r'=F'(\theta)=F[(180+\theta)\bmod 360] \quad (5)$$

Following equations (1) through (5), we can calculate the table of the new contour. If we establish the three coordinate transformations altogether, then we can follow the transformation sequence, change the original table into a new table after the first coordinate transformation, finally change this new table again into another new table after the second coordinate transformation,—and so on, until all the transformations are complete. In this manner, we can obtain the final contour table, then calculate the length and width of a single pattern in accordance with the data shown in the table. This process is illustrated as follows: Among the 360 points from the table, first find out the maximum and minimum horizontal and vertical projected values away from the pattern's start stitch point. We can then calculate that particular pattern's range of length and width as follows.

$$W = px - nx(\text{maximum width of a pattern}); \quad (6)$$
$$L = py - ny(\text{maximum length of a pattern}); \quad (7)$$

where:

$px = \max[F(\theta)\cos\theta | 0 \leqq \theta \leqq 359]$;
(maximum horizontal value)
$nx = \min[F(\theta)\cos\theta | 0 \leqq \theta \leqq 359]$;
(minimum horizontal value)
$py = \max[F(\theta)\sin\theta | 0 \leqq \theta \leqq 359]$;
(maximum vertical value)
$ny = \min[F(\theta)\sin\theta | 0 \leqq \theta \leqq 359]$;
(minimum vertical value)

(2) Calculation of Repeated Embroidering:

Beside setting conditions for coordinate transformation, the computer-aided embroidery machine often uses the function of repeated embroidering to perform such task as arm-badge embroidering, for generation a lot of finished products to attain high productivity with a single preparation. To set the repeated embroidering, the operator must input the repeating number (Rx) in horizontal direction, the repeating number (Ry) in vertical direction, as well as the horizontal interval (H), and the vertical interval (V) between patterns (i.e. the horizontal and vertical distances between the start stitch points of each pattern). As a result, the results obtained from the calculation by use of formula (6), (7), and the actual embroidering length and width, as shown in FIG. 4, are $$\left.\begin{aligned} W &= w + (Rx - 1) \times H \\ L &= 1 + (Ry - 1) \times V \end{aligned}\right\} \quad (8)$$

To summarize the above statements, we can understand that this invention provides a very efficient, convenient, and fast computer-aided method and device without adding extra hardware. It can be applied not only in computer-aided embroidery machines but also in common sewing machines by installing the devices in them. It improves the shortcomings of the prior arts and greatly upgrades the efficiency of the embroidering production so as to conform to the productivity and manufacturing efficiency of modern times. It also promotes long-term developments of the embroidering-related textile industry. It is really a great breakthrough. Also, this invention is not found in any publications, and is completely in conformity with the essential legal regulations of patent law.

What is claimed is:

1. A computer-aided embroidery machine for preparation and testing of a pattern having a predetermined size comprising:

(a) means for comparing the size of said pattern with an embroidery table device to determine if an intended embroidery operation will exceed a defined boundary of said embroidery table device;

(b) means for determining an embroidery frame; and (c) means for providing a completed simulation and a trial embroidering process within said embroidery frame without actually lowering a needlebar for testing the validity of a pattern layout;

(d) wherein said pattern layout includes multiple copies of said pattern, and one copy of said pattern is displayed in full shape while the remaining copies of said pattern are displayed by contour in broken lines.

2. The computer-aided embroidery machine for pattern preparation and testing as claimed in claim 1, wherein said pattern has a contour and said computer-aided embroidery machine further comprises:

(a) means for performing a data preprocessing cycle which converts the contour of the pattern into a contour table containing the positional coordinates of said contour;

(b) means for performing a data postprocessing cycle which projects the maximum horizontal and vertical length of the contour against a stitch start point and derives the allowable embroidering width and length; and (c) means for performing a machine embroidering testing cycle which performs a completed simulation and trial run of an embroidering operation to make sure that the embroidery pattern falls within said defined boundary of said embroidery table device.

3. A computer-aided embroidery machine for pattern preparation and testing as claimed in claim 1 wherein said embroidery table device comprises a pair of X, Y-axes stepped motor drives, a pair of X, Y-axes stepped motors, and a pair of X, Y-axes home point limit switches.

4. A computer-aided embroidery machine for pattern preparation and testing as claimed in claim 1 which further comprises a controller, which includes a central processing unit, a data memory device, and an input/output interface device; said controller is structured to accept input data and issue commands to move said embroidery table device for performing a simulation testing and to move the needlebar to perform a desired embroidery operation.

5. A computer-aided embroidery machine for pattern preparation and testing as claimed in claim 4, wherein said controller is provided by a personal computer, which further provides a display device, a keyboard and a disk storage device.

6. A method for preparation and testing of a pattern employing a computer-aided embroidery machine, said pattern having a predetermined size and said method comprising the steps of:

(a) comparing the size of said pattern with an embroidery table device to determine if an intended embroidery operation will exceed a defined boundary of said embroidery table device;

(b) determining an embroidery frame; and (c) providing a completed simulation and a trial embroidering process within said embroidery frame without actually lowering a needlebar for testing the validity of a pattern layout;

(d) wherein said pattern layout includes multiple copies of said pattern, and one copy of said pattern is displayed in full shape while the remaining copies of said pattern are displayed by contour in broken lines.

7. The method for preparation and testing of a pattern employing a computer-aided embroidery machine as claimed in claim 6, wherein said pattern has a contour and said method further comprises the steps of:

(a) performing a data preprocessing cycle which converts the contour of the pattern into a contour table containing the positional coordinates of said contour;

(b) performing a data postprocessing cycle which projects the maximum horizontal and vertical length of the contour against a stitch start point and derives the allowable embroidering width and length; and (c) performing a machine embroidering testing cycle which performs a completed simulation and trial run of an embroidering operation to make sure that the embroidery pattern falls within said defined boundary of said embroidery table device.

8. The method for preparation and testing of a pattern employing a computer-aided embroidery machine as claimed in claim 6 wherein said embroidery table device comprises a pair of X, Y-axes stepped motor drives, a pair of X, Y-axes stepped motors, and a pair of X, Y-axes home point limit switches.

9. The method for preparation and testing of a pattern employing a computer-aided embroidery machine as claimed in claim 8 wherein said computer-aided embroidery machine further comprises a controller, which includes a central processing unit, a data memory device, and an input/output interface device; said controller is structured to accept input data and issue commands to move said embroidery table device for performing a simulation testing and to move the needlebar to perform a desired embroidery operation.

10. The method for preparation and testing of a pattern employing a computer-aided embroidery machine as claimed in claim 9, wherein said controller is provided by a personal computer, which further provides a display device, a keyboard and a disk storage device.

* * * * *